US007720424B2

(12) United States Patent
Yoda et al.

(10) Patent No.: US 7,720,424 B2
(45) Date of Patent: May 18, 2010

(54) IMAGE FORMING APPARATUS AND FIXING DEVICE THEREFOR

(75) Inventors: Junya Yoda, Osaka (JP); Takayuki Ishida, Osaka (JP)

(73) Assignee: KyoceraMita Corporation, Osaka (JP)

( * ) Notice: Subject to any disclaimer, the term of this patent is extended or adjusted under 35 U.S.C. 154(b) by 261 days.

(21) Appl. No.: 12/079,960

(22) Filed: Mar. 31, 2008

(65) Prior Publication Data

US 2008/0267677 A1 Oct. 30, 2008

(30) Foreign Application Priority Data

Apr. 4, 2007 (JP) ..... 2007-098760
Apr. 4, 2007 (JP) ..... 2007-098784
Apr. 17, 2007 (JP) ..... 2007-107792

(51) Int. Cl.
*G03G 15/20* (2006.01)

(52) U.S. Cl. ..... 399/335; 219/619; 399/330; 399/334

(58) Field of Classification Search ..... 219/619; 399/320, 328, 330, 334, 335
See application file for complete search history.

(56) References Cited

U.S. PATENT DOCUMENTS 6,320,168 B1 * 11/2001 Kimata et al. ..... 219/619
6,795,679 B2 9/2004 Shimizu et al.
7,194,234 B2 * 3/2007 Katakabe et al. ..... 399/330
2002/0131798 A1 9/2002 Hattori

FOREIGN PATENT DOCUMENTS

JP 2002-278328 9/2002
JP 2003-223063 8/2003
JP 2004-325678 11/2004
JP 2007-078825 3/2007
JP 2007-079131 3/2007
JP 2007-140329 6/2007

* cited by examiner

*Primary Examiner*—Hoang Ngo
(74) *Attorney, Agent, or Firm*—Jordan and Hamburg LLP

(57) ABSTRACT

In order to efficiently utilize the energy of the flux leaked from the vicinities of the edges of a fixing roller having a part to be heated, which is made of magnetic material that has Curie point, the energy of the leaked flux is stored to be utilized as need arises, or is utilized to heat the vicinity of the center of the fixing roller.

15 Claims, 9 Drawing Sheets

(b)

(a)

(b)

(a)

IMAGE FORMING APPARATUS AND FIXING DEVICE THEREFOR

BACKGROUND OF THE INVENTION

1. Field of the Invention

The present invention relates to a fixing device of an electromagnetic induction heat system for heating a fixing roller, and more particularly, to a technology for preventing excessive heating of the vicinities of the edges of said fixing roller.

2. Description of the Related Art

Art A fixing device of an electromagnetic induction heat system for heating a fixing roller by electromagnetic induction is used in image forming apparatuses, such as printers, copiers, facsimiles, and MFPs thereof.

More specifically, an electromagnetic coil is disposed inside of a tubular fixing roller made of magnetic material, and alternating current is provided therein so that flux is generated. This generates eddy current (induced current) to produce heat in the fixing roller, resulting from electromagnetic induction occurred by flux (magnetic field) in the electromagnetic coil. The image forming apparatus structured as such generally conducts temperature control of the fixing roller based on the detection result of the temperature sensor, that detects the temperature of the fixing roller, by means of controlling alternating current applied to the electromagnetic coil.

When a small-sized paper is used in printing output, there have been conventionally occurred a problem of excessive heating of a non-paper-passing area, where the paper does not pass through, in the vicinity of the edge of the fixing roller. Here, for example, Japanese Unexamined Patent Publication No. 2004-325678 has been disclosing a structure which uses magnetic shunt alloy in the fixing roller for the purpose of preventing excessive heating in the non-paper-passing area in the fixing roller. For confirmation, magnetic shunt alloy has a property for rapidly decreasing its magnetic quality when it reaches the Curie point.

In such a structure, the magnetic quality in the non-paper-passing area rapidly decreases when the temperature in the non-paper-passing area of the fixing roller exceeds the Curie point of its magnetic shunt alloy, thereby rapidly reducing the eddy current occurred from electromagnetic induction. Hence, excessive heating of the non-paper-passing area of the fixing roller can be prevented without using a temperature sensor, a thermostat, and the like.

On the other hand, for example, Japanese Unexamined Patent Publication No. 2003-223063 has been disclosing a structure in which a metal, such as copper, having diamagnetism is provided in the circumference of the fixing roller made of magnetic materials. For confirmation, diamagnetism means a nature to be magnetized in the opposing direction of the flux. In such a structure, when the flux passing through the fixing roller from the electromagnetic coil leaks, this leaked flux can therefore be prevented to leak to the outside because of the counteraction of the metal of diamagnetism.

However, both Japanese Unexamined Patent Publications No. 2004-325678 and No. 2003-223063 are still having a problem that the flux, which is leaked from the fixing roller due to the temperature rise in the non-paper-passing area of the fixing roller, is counteracted or discharged as it is to the outside, leaving the energy of the flux vainly consumed.

In view of the above problem residing in the prior arts, it is an object of the present invention to provide an image forming apparatus and a fixing device therefor which efficiently utilize the energy of the leaked flux that is leaked from the vicinities of the edges of the fixing roller.

SUMMARY OF THE INVENTION

As a method for efficiently utilizing the energy of the flux leaked from the vicinities of the edges of the fixing roller, there may be two ways: storing the energy of the leaked flux and utilizing it as need arises, or utilizing it for heating the vicinity of the center of the above-mentioned fixing roller.

A first aspect in accordance with this invention, in which the energy of the flux that is leaked from the vicinities of the edges of a fixing roller is stored, is applied to a fixing device comprising; a fixing roller having a part to be heated, which is made of magnetic material that has Curie point, and a heating means of electromagnetic induction for heating the part to be heated by electromagnetic induction, wherein one or a plurality of generating means of induced electromotive force for generating induced electromotive force by means of flux, which has passed from the electromagnetic induction heating means through the part to be heated in the vicinity of the one or both edges of the fixing roller, and one or a plurality of storing means of induced electromotive force for storing induced electromotive force that is generated by the generating means of induced electromotive force, are provided.

In the first aspect in accordance with this invention, for example, when the temperature of the non-paper-passing areas in the vicinity of the edges of the fixing roller where the paper does not pass through, exceeds the Curie point, the magnetic quality of the part to be heated in the non-paper-passing area rapidly decreases. This results in the leak of the flux that has passed from the heating means of electromagnetic induction through the part to be heated. This leaked flux causes induced electromotive force to be generated by the generating means of induced electromotive force. And the generated induced electromotive force is then stored in the storing means of induced electromotive force. In short, according to the present aspect of this invention, the energy of the flux leaked from the vicinities of the edges of the fixing roller is stored in the storing means of induced electromotive force, thereby being efficiently utilized as need arises.

One example of the storing means of induced electromotive force is, for example, a secondary battery, a condenser, and the like. The induced electromotive force stored in a secondary battery, a condenser, and the like then may be removed and utilized.

Now, when the electricity or the rate of electricity change of the induced electromotive force stored in the storing means of induced electromotive force exceeds a certain value, it may be considered that excessive heating in the vicinity of the edge of the fixing roller is occurred. Therefore, it is capable to detect whether or not excessive heating of the vicinities of the one or both edges of the fixing roller is occurred, based on the electricity or the rate of electricity change of the induced electromotive force stored in the storing means of induced electromotive force.

And the present aspect of this invention can also be understood as an invention of an image forming apparatus. In short, the first aspect of this invention understood as an image forming apparatus comprises a fixing device comprising; a fixing roller having a part to be heated, which is made of magnetic material that has Curie point, and a heating means of electromagnetic induction for heating the part to be heated by electromagnetic induction, and said image forming apparatus comprises one or a plurality of generating means of induced electromotive force for generating induced electromotive force by means of flux, which has passed from the electromagnetic induction heating means through the part to be heated in the vicinity of the one or both edges of the fixing roller, and one or a plurality of storing means of induced electromotive force for storing induced electromotive force that is generated by the generating means of induced electromotive force.

There are second and third aspects in accordance with the present invention in which the energy of the leaked flux is utilized for heating the vicinity of the center of the above-mentioned fixing roller. The second aspect in accordance with the present invention is applied to a fixing device comprising; a fixing roller having a part to be heated, which is made of magnetic material that has Curie point, and a heating means of electromagnetic induction for heating the part to be heated by electromagnetic induction, wherein one or a plurality of generating means of induced electromotive force for generating induced electromotive force by means of flux, which has passed from the electromagnetic induction heating means through the part to be heated in the vicinity of the one or both edges of the fixing roller, and one or a plurality of heating means of induced electromotive force for heating the vicinity of the center of the fixing roller with the induced electromotive force that is generated by the generating means of induced electromotive force, are provided.

In this second aspect in accordance with this invention, for example, when the temperature of the non-paper-passing areas in the vicinity of the edges of the fixing roller where the paper does not pass through, exceeds the Curie point, the magnetic quality of the part to be heated in the non-paper-passing area rapidly decreases. This results in the leak of the flux that has passed from the heating means of electromagnetic induction through the part to be heated. This leaked flux causes the generating means of induced electromotive force to generate induced electromotive force. The use of the thus generated induced electromotive force allows the heating means of induced electromotive force to heat the vicinity of the center of the fixing roller. In short, according to this second aspect of this invention, the energy of the flux leaked from the vicinities of the edges of the fixing roller can be utilized to heat the vicinity of the center of the fixing roller, thereby enhancing the energy consumption efficiency.

One example of the heating means of induced electromotive force is, for example, a resistance heating element, a halogen heater, and the like. Such resistance heating element, a halogen heater, and the like, heat the vicinity of the center of the fixing roller by means of the induced electromotive force.

This second aspect of this invention can be understood as an invention of the image forming apparatus as described below. In short, the second aspect of this invention provides an image forming apparatus comprising a fixing device which comprises; a fixing roller having a part to be heated, which is made of magnetic material that has Curie point, and a heating means of electromagnetic induction for heating the part to be heated by electromagnetic induction, and said image forming apparatus comprises one or a plurality of generating means of induced electromotive force for generating induced electromotive force by means of flux, which has passed from the electromagnetic induction heating means through the part to be heated in the vicinity of the one or both edges of the fixing roller, and one or a plurality of heating means of induced electromotive force for heating the vicinity of the center of the fixing roller with the induced electromotive force generated by means of the generating means of induced electromotive force.

A third aspect in accordance with this invention in which the energy of the leaked flux is utilized to heat the vicinity of the center of the fixing roller, is applied to a fixing device comprising; a fixing roller having a part to be heated, which is made of magnetic material that has Curie point, and a heating means of electromagnetic induction for heating the part to be heated by electromagnetic induction, wherein one or a plurality of flux guiding means for guiding the flux, which has passed from the electromagnetic induction heating means through the part to be heated in the vicinity of the one or both edges of the fixing roller, to the part to be heated in the vicinity of the center of the fixing roller is provided.

In the third aspect of this invention, for example, when the temperature of the non-paper-passing areas in the vicinity of the edges of the fixing roller where the paper does not pass through, exceeds the Curie point, the magnetic quality of the part to be heated in the non-paper-passing area rapidly decreases. This results in the leak of the flux that has passed from the heating means of electromagnetic induction through the part to be heated. The leaked flux is then guided to the part to be heated in the vicinity of the center of the fixing roller by the flux guiding means. Consequently, this causes the flux in the part to be heated in the vicinity of the center of the fixing roller to increase, thereby increasing the induced current generated in the part to be heated by electromagnetic induction. In short, according to this third aspect of this invention, the energy of the flux leaked from the vicinities of the edges of the fixing roller can be utilized to heat the vicinity of the center of the fixing roller, thereby enhancing the energy consumption efficiency.

One example of the flux guiding means is, for example, a magnetic body having a nearly-U shape, and disposed as extending across from the vicinity of the edge to the vicinity of the center of the fixing roller. This allows the flux leaked from the vicinities of the edges of the fixing roller to be guided to the vicinity of the center of the fixing roller via the magnetic body.

This third aspect of this invention may be understood as an invention of an image forming apparatus. In short, the third aspect of this invention is applied to an image forming apparatus comprising a fixing device, which comprises; a fixing roller having a part to be heated, which is made of magnetic material that has Curie point, and a heating means of electromagnetic induction for heating the part to be heated by electromagnetic induction, and said image forming apparatus comprises one or a plurality of flux guiding means for guiding the flux, which has passed from the electromagnetic induction heating means through the part to be heated in the vicinity of the one or both edges of the fixing roller, to the part to be heated in the vicinity of the center of the fixing roller.

In any one of the above-mentioned aspects of this invention, the part to be heated may be made of any magnetic material that has the Curie point, however, magnetic shunt alloy having property for rapidly decreasing its magnetic quality when it exceeds the Curie point is preferred to be used as the magnetic material.

And also, as an example of the generating means of induced electromotive force, an electromagnetic coil may be used. The electromagnetic coil generates induced electromotive force (induced current) by means of the flux, which has passed from the heating means of electromagnetic induction through the part to be heated.

DETAILED DESCRIPTION OF THE PREFERRED EMBODIMENTS

In what follows, as referring to the accompanied figures, an embodiment of the first aspect of this invention in which the leaked flux is stored is described.

Figure 1:
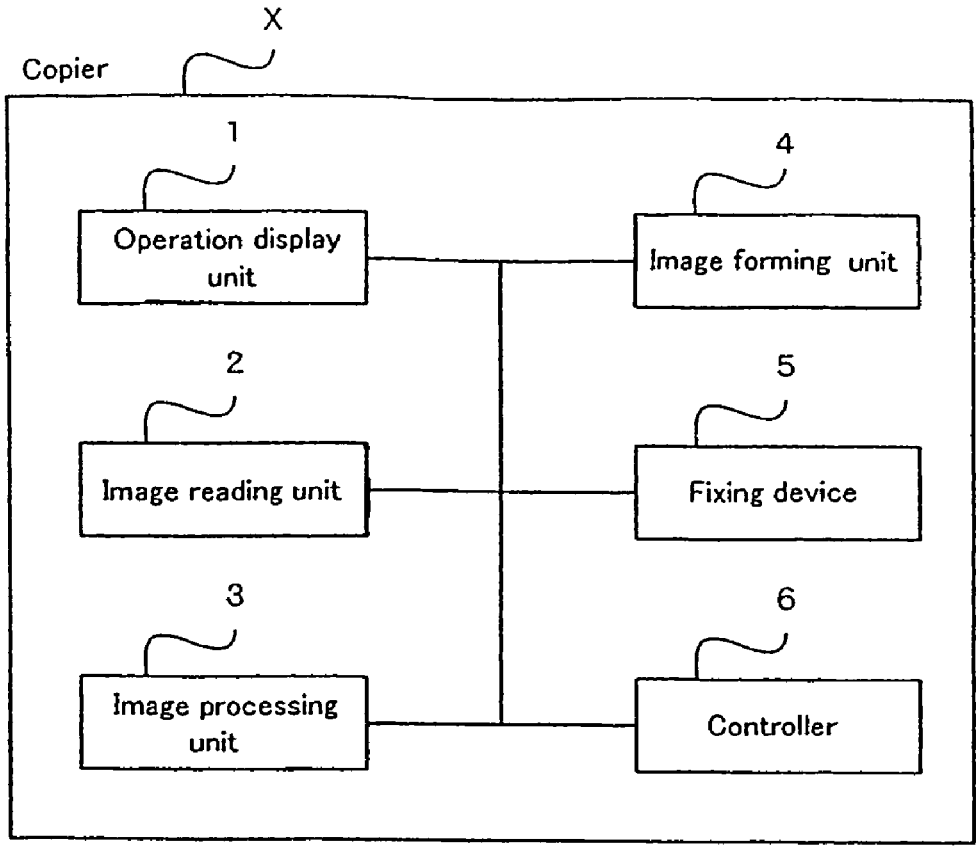
FIG. 1 shows a block diagram schematically illustrating the configuration of a copier X according to an embodiment common to the present invention.

As shown in FIG. 1, a copier X according to one embodiment of the present aspect comprises; an operation display unit 1 including such as a liquid crystal display and a touch panel for conducting various information display and inputting operation, an image reading unit 2 for reading images on a manuscript stacked on a platen or an ADF (automatic document feeder), a image processing unit 3 for conducting various image processing to an image data on the manuscript read by the image reading unit 2 or to an image data on the manuscript input from a data processing device not shown connected via a communication network such as a LAN, an image forming unit 4 consisted of such as a photoreceptor drum, a charger, a developing device, and a LSU for forming a toner image (developer) on a paper sheet based on an image data of the manuscript input from the image processing unit 3, a fixing device 5 for melt-fixing on a paper sheet the toner image formed on the paper sheet by the image forming unit 4, and a controller 6 consisted of peripheral devices such as a CPU, a ROM, and a RAM for controlling the overall copier X by conducting processing according to a prescribed program stored in the ROM.

The copier X also has various constituent elements which general copiers of electrophotographic system have, however, the detailed explanation thereof is eliminated. In addition, the copier X is merely an example of an image forming apparatus according to the present aspect of this invention, and such as printers, facsimiles, and MFPs also fall under image forming apparatuses in accordance with the present aspect. The copier X according to one embodiment of the present aspect has a particular feature in its structure of the fixing device 5, and the following is describing this feature in details.

Figure 2:
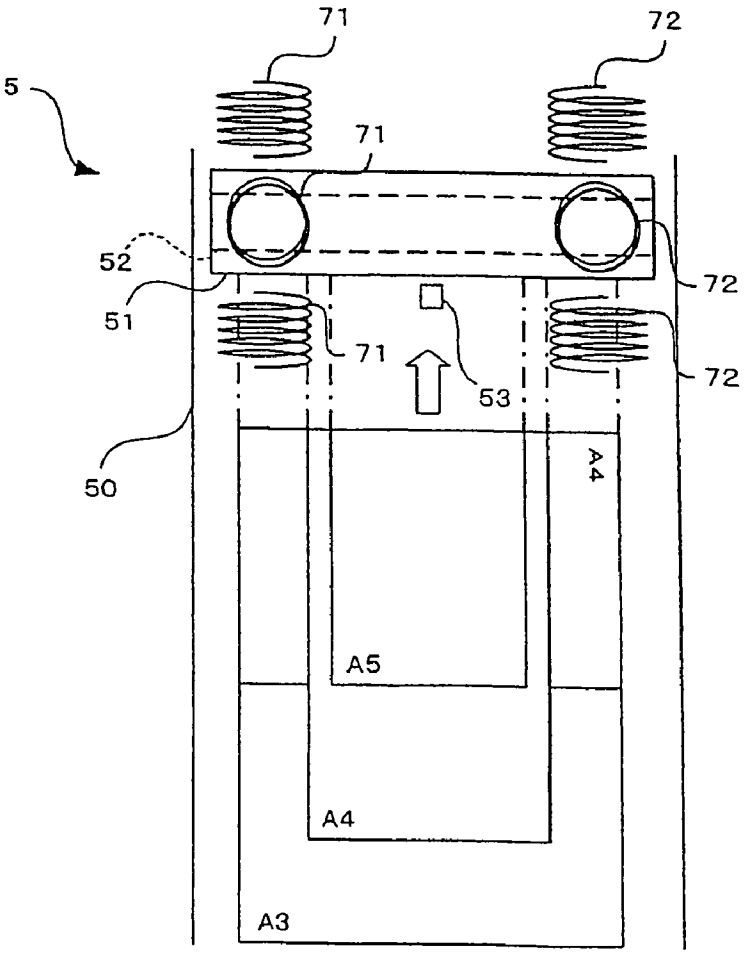
FIG. 2 shows a pattern diagram schematically illustrating a fixing device 5 according to an embodiment of the first aspect of this invention of when the leaked flux is stored.
Figure 2:
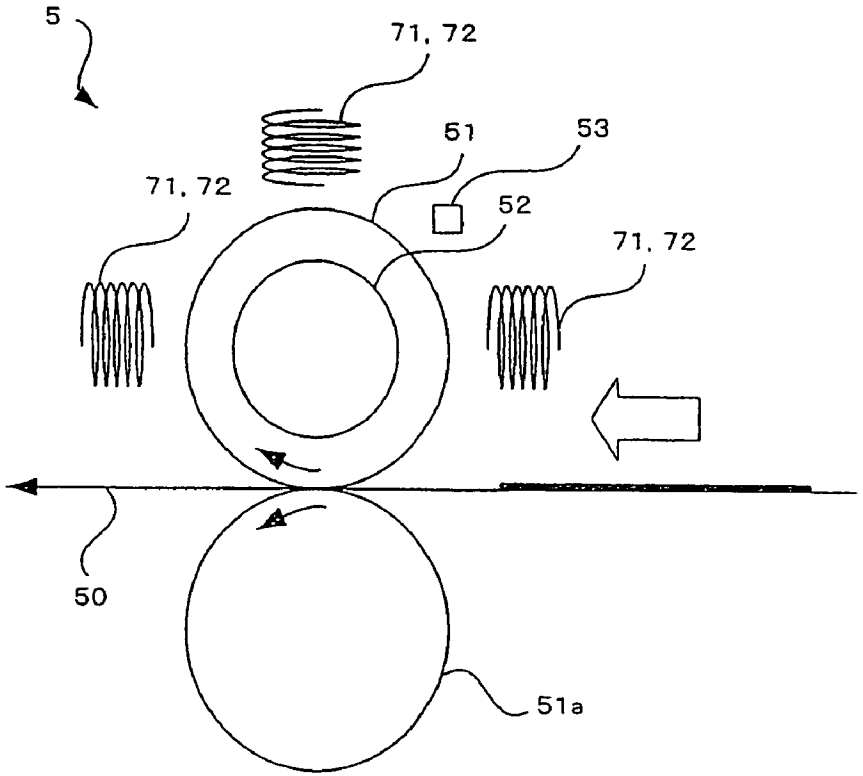

Firstly, as referring to the pattern diagram in FIG. 2, the general structure of the fixing device 5 is described. Here, FIG. 2(*a*) shows a side view and FIG. 2(*b*) shows an overhead view, both of the fixing device 5.

As shown in FIG. 2, the fixing device 5 comprises; a fixing roller 51 for melt-fixing a toner image on various sized paper sheets such as A3 to A5 on which the toner image has already attached by the image forming unit 4, a pressing roller 51*a* which revolves as pressure welding the paper sheet along with the fixing roller 51, a heater 52 of electromagnetic induction heat system provided inside of the fixing roller 51 for heating thereof (one example of a heating means of electromagnetic induction), a center area temperature sensor 53 such as a thermistor placed in the vicinity of the center of the fixing roller 51, and later-described electromagnetic coils 71 and 72 (one example of a generating means of induced electromotive force).

The center area temperature sensor 53 detects the temperature in the vicinity of the center of the fixing roller 51, and inputs the detection result into the controller 6. The controller 6 conducts the drive control of the heater 52 according to the detected temperature input from the center area temperature sensor 53, so that the temperature of the fixing roller 51 settles to a predetermined fixing temperature (for example, around 200 centigrade). Regarding the temperature control of the fixing roller 51, there is no difference from conventional devices, and the detailed explanation thereof is eliminated.

Figure 3B:
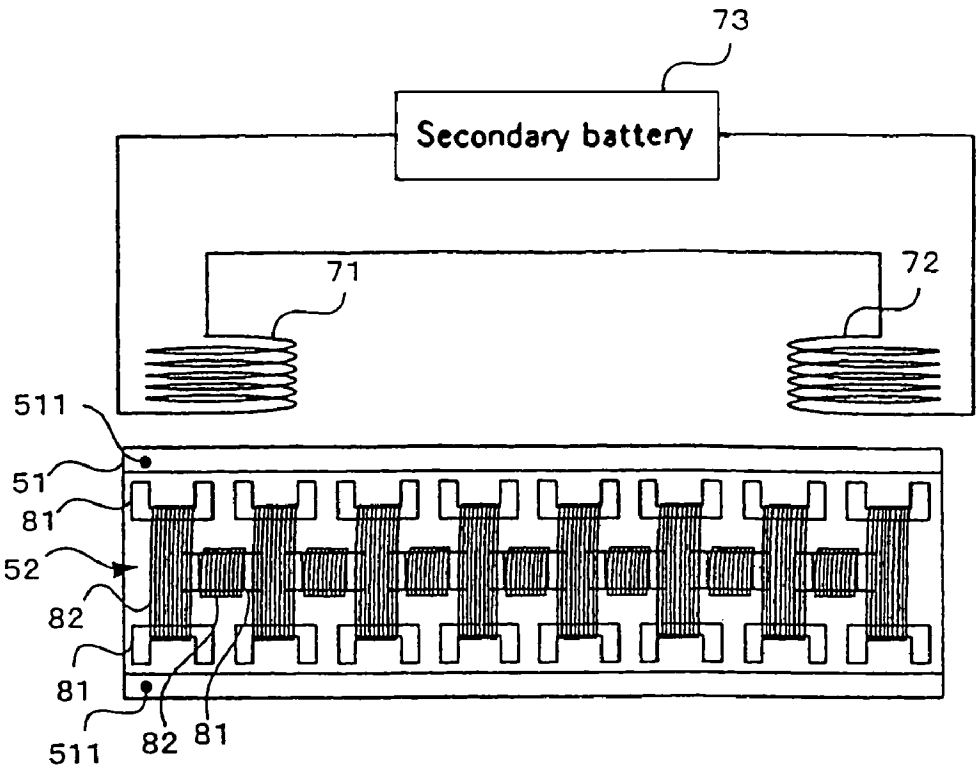
FIG. 3 shows a pattern diagram illustrating the inner structure of a fixing device 5 according to an embodiment of the first aspect of this invention of when the leaked flux is stored.
Figure 3A:
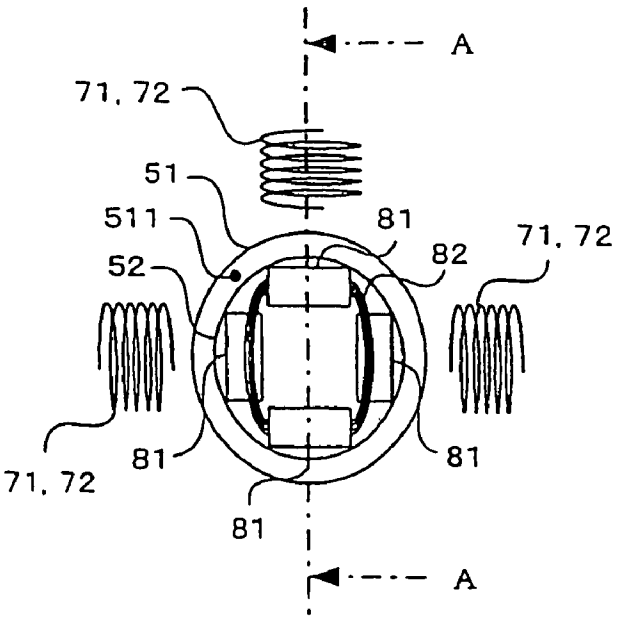

Next, as referring now to FIG. 3, the fixing device 5 is described in details. Here, FIG. 3(*a*) shows a longitudinal cross-sectional view of the heater 52, and FIG. 3(*b*) shows a cross-sectional view which is viewed along the arrow A and taken along the line A-A in FIG. 3(*a*).

As shown in FIG. 3, the fixing roller 51 is formed in a hollow cylinder shape, and has a part to be heated 511 formed with magnetic shunt alloy (one example of magnetic material), that has the Curie point (for example, around 220 centigrade). The magnetic shunt alloy may be, for example, alloy such as iron, nickel, and chrome. As described above, the magnetic shunt alloy has a property for rapidly decreasing its magnetic quality when its temperature reaches the Curie point. In addition, any magnetic material that has Curie point, other than magnetic shunt alloy, may be used.

In the fixing device 5, when printing output is conducted by using a paper sheet having the width smaller than the maximum paper-passing width of the fixing roller 51, and moreover, when the temperature of the non-paper-passing area in the vicinity of the edges of the fixing roller 51 rises and exceeds the Curie point, the magnetic quality of the non-paper-passing area rapidly decreases, thereby rapidly reducing the eddy current generated by electromagnetic induction. This allows to secure the safety by preventing excessive heating of the vicinities of the edges of the fixing roller 51 without using a temperature sensor that detects the temperature of the vicinities of the edges.

On the other hand, the heater 52 comprises electromagnetic coils 82 coiled sequentially to a plurality of iron cores 81 and a driving circuit 83 (see FIG. 4) for applying alternating current to the electromagnetic coil 82.

The heater 52 generates flux (magnetic field) at the electromagnetic coil 82 by applying alternating current thereto from the driving circuit 83 (see FIG. 4), so that eddy current (induced current) is occurred in the part to be heated 511 in the fixing roller 51 by electromagnetic induction, thereby heating the part to be heated 511. In addition, the fixing roller 51 is revolved by a driving means not shown, so as to be heated uniformly in its whole circumference by the heater 52.

And also, as illustrated in FIG. 3, provided in the circumference of the fixing roller 51 in the fixing device 5 are; electromagnetic coils 71 and 72 for generating induced electromotive force by the flux that has passed from the electromagnetic coil 82 through the part to be heated 511 in the vicinity of both the edges of the fixing roller 51, and a secondary battery 73 that is connected in series to the electromagnetic coils 71 and 72. Here, the electromagnetic coils 71 and 72 may be connected either in series or in parallel. Also, the electromagnetic coils 71 and 72 may be independently connected to the different secondary batteries 73 in another embodiment. FIG. 3 shows a state in which the electromagnetic coils 71 and 72 are coiled with air core, however, they may be coiled to a magnetic body such as an iron core.

The secondary battery 73 is merely one example of a storing means of induced electromotive force for storing induced electromotive force generated in the electromagnetic coils 71 and 72, and such as a condenser may be used alternatively.

The electromagnetic coils 71 and 72 are provided in positions corresponding to those of iron cores 81 inside of the heater 52. Additionally, one example of the structure in which three pairs of the electromagnetic coils 71 and 72 are provided is illustrated in FIG. 3, however, there may be at least one pair of the electromagnetic coils 71 and 72. Moreover, in an image forming apparatus in which the paper sheet passing on the fixing roller 51 passes along any one of the edges of the fixing roller 51, the electromagnetic coil may be provided in the vicinity of that edge.

In the thus constituted fixing device 5, when flux is leaked from the vicinities of the edges of the fixing roller 51, induced electromotive force (induced current) is generated in the electromagnetic coils 71 and 72 by the leaked flux.

Figure 4B:
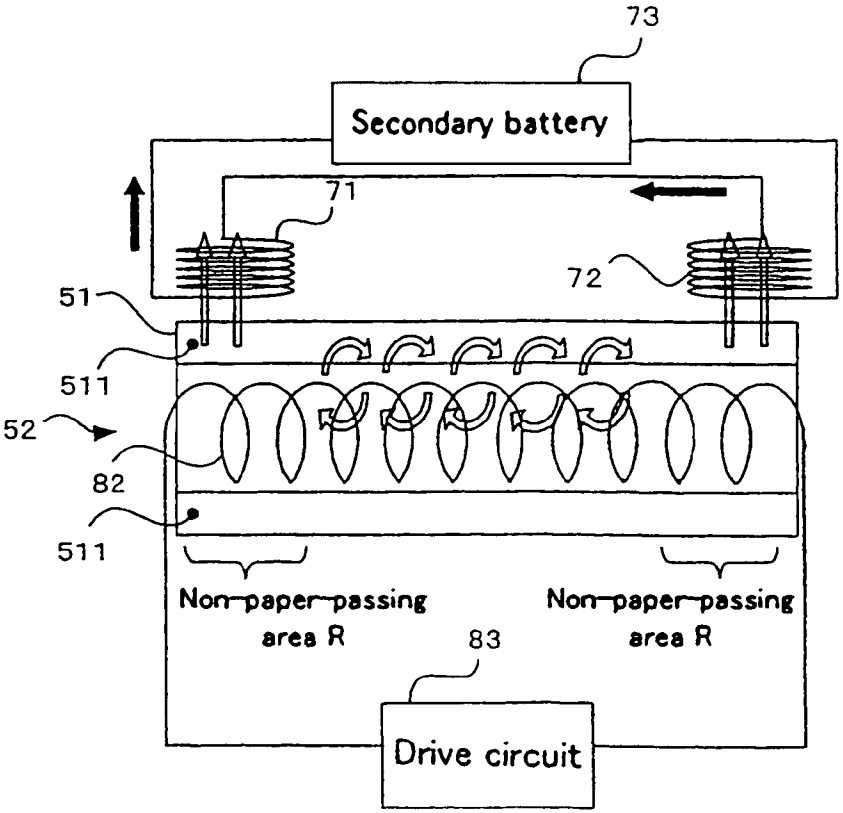
FIG. 4 shows a pattern diagram of the general concept for explaining a state of the flux in a fixing device 5 according to an embodiment of the first aspect of this invention of when the leaked flux is stored.
Figure 4A:
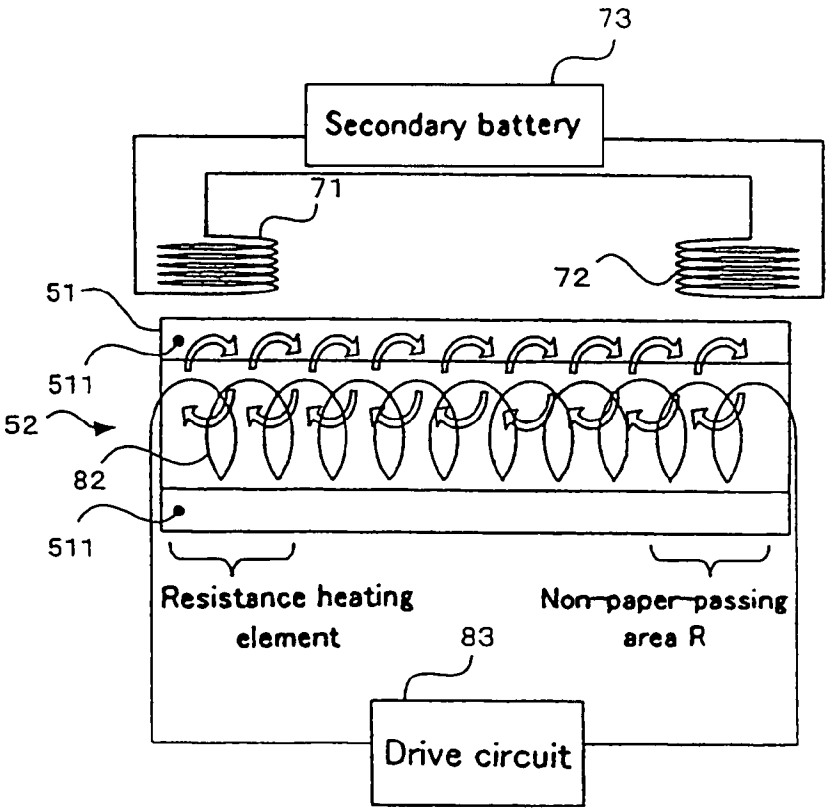

In what follows, as referring now to FIG. 4, a state of the flux in the fixing device 5 is described. Here, FIG. 4(*a*) shows a pattern diagram of the general concept of a state of the flux of when the temperature of the vicinities of the edges of the fixing roller 51 is lower than the Curie point, and FIG. 4(*b*) also shows a pattern diagram of the general concept of a state of the flux of when the temperature of the vicinities of the edges of the fixing roller 51 reaches the Curie point.

As shown in FIG. 4(*a*), in the condition when the temperature in the vicinity of the edge of the fixing roller 51 is lower than the Curie point, eddy current (induced current) by electromagnetic induction occurs in the entire part to be heated 511 of the fixing roller 51 due to the flux (see the arrows shown in the figure) generated in the electromagnetic coil 82, thereby heating the entire part to be heated 511.

However, when printing processing is repeatedly conducted using a paper sheet having the width smaller than the longitudinal width of the fixing roller 51, so called the maximum paper-passing size, the temperature of non-paper-passing areas R in the vicinity of both the edges of the fixing roller 51 rises higher than that of the vicinity of the center of the fixing roller 51.

Here, in the copier X, since the drive of the heater 52 is controlled so that the temperature of the vicinity of the center of the fixing roller 51 that has been detected by the center area temperature sensor 53 settles to a predetermined fixing temperature (for example, around 200 centigrade), only the temperature of the non-paper-passing areas R in the vicinity of the edges of the fixing roller continuously increases.

After that, with the rise of the temperature of the non-paper-passing area R in the vicinity of the edge of the fixing roller 51, when the temperature of the part to be heated 511 in the non-paper-passing area R reaches the Curie point (for example, around 220 centigrade), the magnetic quality of the part to be heated 511 in the non-paper-passing area R rapidly decreases.

And then, as illustrated in FIG. 4(*b*), the flux (see the arrows shown in the figure) from the electromagnetic coil 82 leaks to the outside. Consequently, the rapid decrease of eddy current, which is generated by electromagnetic induction, in the part to be heated 511 in the non-paper-passing area R prevents further temperature rise of the non-paper-passing area R. As described, the use of magnetic shunt alloy as magnetic material that has Curie point for the part to be heated 511 prevents excessive heating of the part to be heated 511 above the Curie point in the fixing device 5.

On the other hand, as illustrated in FIG. 4(*b*), the flux, which is leaked from the electromagnetic coil 82 of the heater 52 through the part to be heated 511 in the non-paper-passing areas R in the vicinity of both the edges of the fixing roller 51, acts on the electromagnetic coils 71 and 72.

This generates induced electromotive force (induced current) in the electromagnetic coils 71 and 72 due to the flux leaked from the part to be heated 511. The induced electromotive force generated in the electromagnetic coils 71 and 72 then flows into the secondary battery 73.

Thus, the induced electromotive force generated in the electromagnetic coils 71 and 72 is stored in the secondary battery 73. In short, the energy of the flux leaked from the vicinities of the edges of the fixing roller 51 is stored in the secondary battery 73.

The secondary battery 73 in which the induced electromotive force is stored can then be utilized for various power supplies in the copier X. For example, the use of the secondary battery 73 as an auxiliary power for starting up the copier X can shorten the start-up time of the copier X, compared with the start-up using only the electricity from the commercial AC source. In addition, the secondary battery 73 may be used as a power source for the driving circuit 83 that applies alternating current to the electromagnetic coil 82.

As described above, in the fixing device 5, the energy of the flux, which is leaked from the vicinities of the edges of the fixing roller 51 and has been uselessly consumed in conventional arts, can be efficiently utilized by being stored in the secondary battery 73.

In the present embodiment, the electromagnetic coil 82 is coiled in the direction same as the circumferential direction of the fixing roller 51 as an example, however, the embodiment can also be applicable to the configuration in which the electromagnetic coil 82 is coiled in the longitudinal direction of the fixing roller 51.

Now, the state: the secondary battery 73 is charging the induced electromotive force due to its generation in the electromagnetic coils 71 and 72, indicates that the temperature of the part to be heated 511 in the non-paper-passing area R in the vicinity of the edge of the fixing roller 51 is reaching the Curie point, showing a state of excessive heating.

Here, by monitoring the electricity (voltage or electrical current) of the secondary battery 73, the detection of excessive heating of the part to be heated 511 in the non-paper-passing area R in the vicinity of the edge of the fixing roller 51 may be achieved, subject to said electricity exceeding a predetermined value. And also, excessive heating of the part to be heated 511 in the non-paper-passing area R may be detected, subject not to the charged amount of electricity in the secondary battery 73, but to the rate of electricity change exceeding a predetermined rate of change.

As mentioned, in the copier X, it is capable to detect whether or not excessive heating of the vicinities of the edges of the fixing roller 51 is occurred, based on the electricity or the rate of electricity change of the induced electromotive force stored in the secondary battery 73. Additionally, such detection processing is conducted according to a prescribed control program by the controller 6. Here, the controller 6 corresponds to an excessive heating detecting means for conducting the above-mentioned detection processing. Moreover, a detection result of excessive heating of the part to be heated 511 in the non-paper-passing area R given by the controller 6 is displayed on, for example, an operation display unit 1 of the copier X, or is reflected to the drive control of the driving circuit 83.

Next, an embodiment of the second aspect of this invention in which the energy of the leaked flux is utilized to heat the vicinity of the center of the fixing roller is described. The copier X referred for describing this aspect is the same as the one in FIG. 1. The general structure of the fixing device 5 is also the same as the one in FIG. 2, and the detailed description thereof is omitted. In what follows, the element which is particular in the second aspect of this invention is described.

Figure 5:
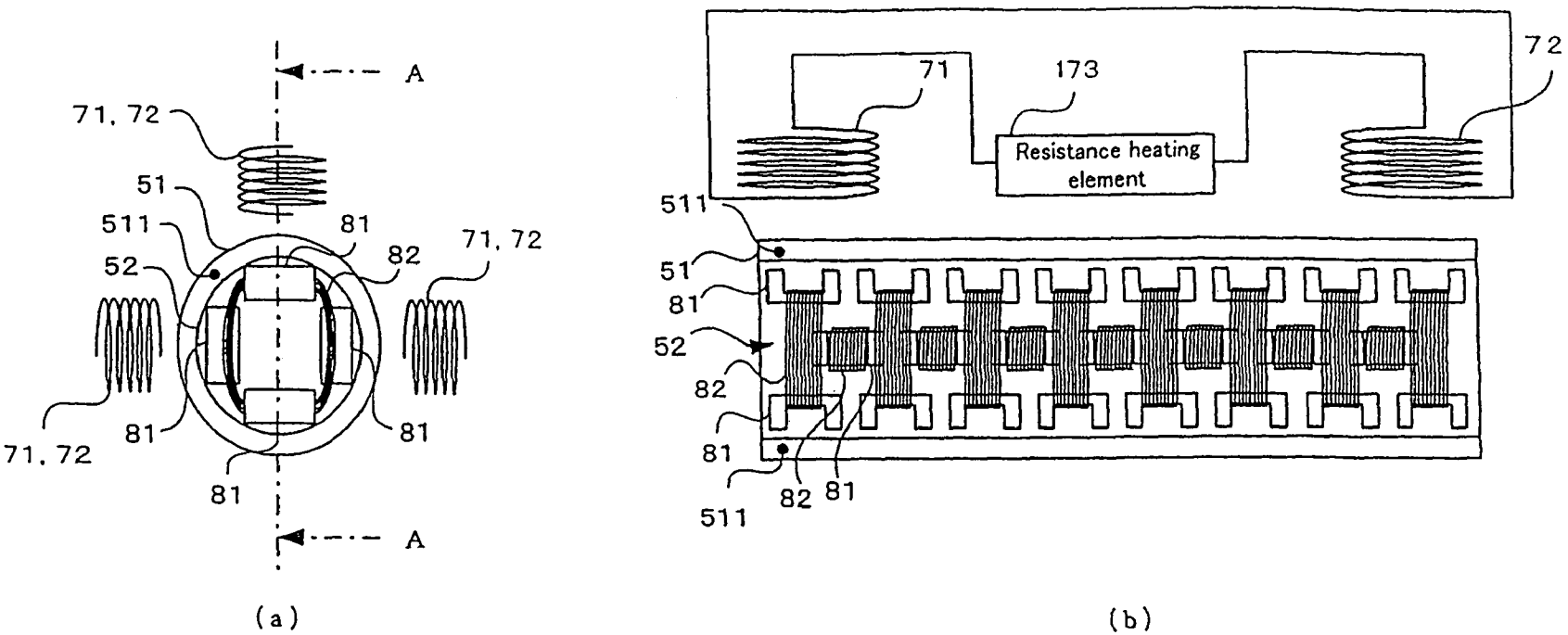
FIG. 5 shows a pattern diagram illustrating the inner structure of a fixing device according to an embodiment of the second aspect of this invention of when the energy of the leaked flux is utilized to heat the vicinity of the center of the fixing roller.

Firstly, as referring to FIG. 5, the details of the fixing device 5 are described. Here, FIG. 5(*a*) shows a longitudinal cross-sectional view of the heater 52, and FIG. 5(*b*) shows a cross-sectional view which is viewed along the arrow "A" and taken along the line A-A in FIG. 5(*a*).

As shown in FIG. 5, the fixing roller 51 is formed in a hollow cylinder shape, and has a part to be heated 511 formed with magnetic shunt alloy (one example of magnetic material), that has the Curie point (for example, around 220 centigrade). The magnetic shunt alloy may be, for example, alloy such as iron, nickel, and chrome. As described above, the magnetic shunt alloy has a property for rapidly decreasing its magnetic quality when its temperature reaches the Curie point. In addition, any magnetic material that has Curie point, other than magnetic shunt alloy, may be used.

In the fixing device 5, for example, when printing output is conducted by using a paper sheet having the width smaller than the maximum paper-passing width of the fixing roller 51, and moreover, when the temperature of the non-paper-passing area in the vicinity of the edge of the fixing roller 51 rises and exceeds the Curie point, the magnetic quality of the non-paper-passing area rapidly decreases, thereby rapidly reducing the eddy current generated by electromagnetic induction. This allows to secure the safety by preventing excessive heating of the vicinities of the edges of the fixing roller 51 without using a temperature sensor that detects the temperature of the vicinities of the edges of the fixing roller 51.

On the other hand, the heater 52 comprises electromagnetic coils 82 coiled sequentially to a plurality of iron cores 81 and a driving circuit 83 (see FIG. 6) for applying alternating current to the electromagnetic coil 82.

The heater 52 generates flux (magnetic field) in the electromagnetic coil 82 by applying alternating current thereto from the driving circuit 83 (see FIG. 6), so that eddy current (induced current) is occurred in the part to be heated 511 in the fixing roller 51 by electromagnetic induction, thereby heating the part to be heated 511. In addition, the fixing roller 51 is revolved by a driving means not shown, so as to be heated uniformly in its whole circumference by the heater 52.

As illustrated in FIG. 5(*b*), provided in the circumference of the fixing roller 51 in the fixing device 5 are; electromagnetic coils 71 and 72 for generating induced electromotive force by the flux that has passed from the electromagnetic coil 82 through the part to be heated 511 in the vicinities of both the edges of the fixing roller 51, and a resistance heating element 173 that is connected in series to the electromagnetic coils 71 and 72. Here, the electromagnetic coils 71 and 72 may be connected either in series or in parallel. Also, the electromagnetic coils 71 and 72 may be independently connected to the different resistance heating elements 173 in another embodiment. FIG. 5 shows a state in which the electromagnetic coils 71 and 72 are coiled with air core, however, they may be coiled to a magnetic body such as an iron core.

The resistance heating element 173 is one example of a heat-producing means of induced electromotive force, which is placed in the vicinity of the center of the fixing roller 51 and heats there by producing heat with induced electromotive force generated in the electromagnetic coils 71 and 72. In stead of the resistance heating element 173, a halogen heater and the like may be used as a heating means.

The electromagnetic coils 71 and 72 are provided in positions corresponding to those of iron cores 81 inside of the heater 52. Additionally, one example of the structure in which three pairs of the electromagnetic coils 71 and 72 are provided is illustrated in FIG. 5(*a*), however, there may be at least one pair of the electromagnetic coils 71 and 72. Moreover, an image forming apparatus, in which the paper sheet passing through the fixing roller 51 passes along any one of the edges of the fixing roller 51, may be provided with the electromagnetic coil in the vicinity of that edge.

In the thus constituted fixing device 5, when the flux is leaked from the vicinities of the edges of the fixing roller 51, induced electromotive force (induced current) is generated in the electromagnetic coils 71 and 72 by the leaked flux.

Figure 6B:
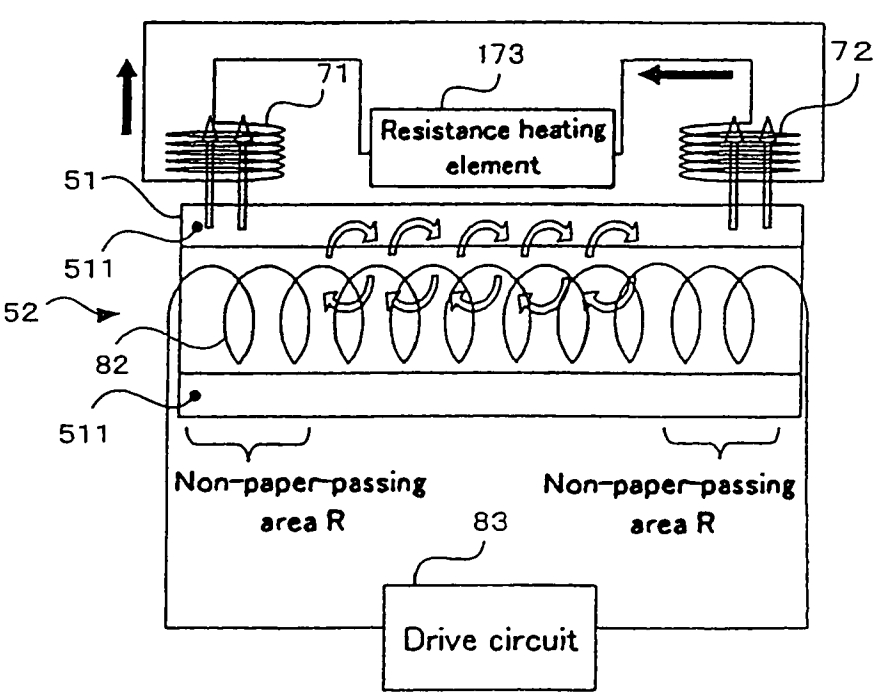
FIG. 6 shows a pattern diagram of the general concept for explaining a state of the flux in a fixing device according to an embodiment of the second aspect of this invention of when the energy of the leaked flux is utilized to heat the vicinity of the center of the fixing roller.
Figure 6A:
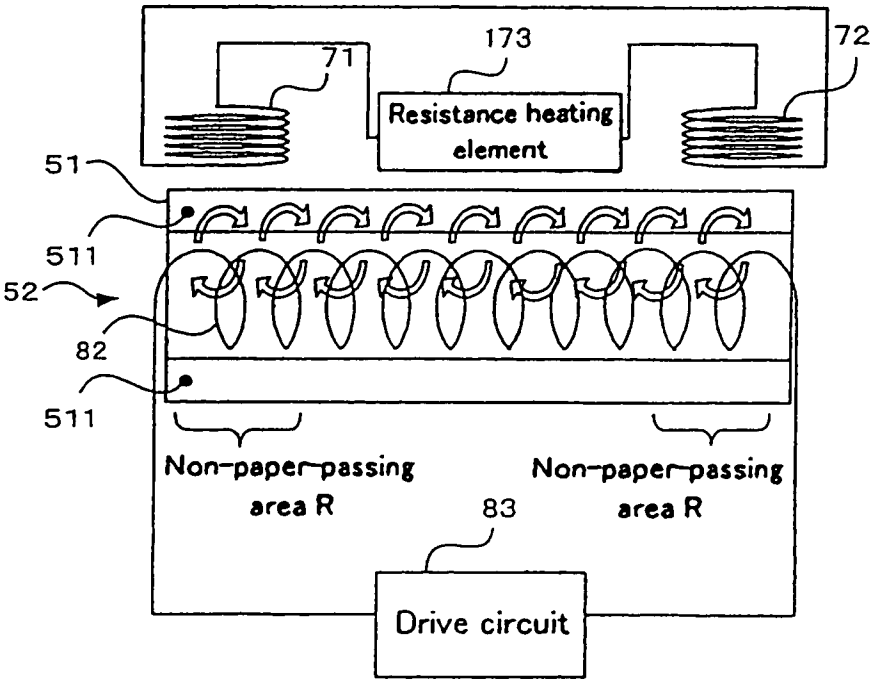

In what follows, as referring now to FIG. 6, a state of the flux in the fixing device 5 is described. Here, FIG. 6(*a*) shows a pattern diagram of the general concept of a state of the flux of when the temperature of the vicinities of the edges of the fixing roller 51 is lower than the Curie point, and FIG. 6(*b*) also shows a pattern diagram of the general concept of a state of the flux of when the temperature of the vicinities of the edges of the fixing roller 51 reaches the Curie point.

As shown in FIG. 6(*a*), in the condition when the temperature in the vicinity of the edge of the fixing roller 51 is lower than the Curie point, eddy current (induced current) by electromagnetic induction occurs in the entire part to be heated 511 of the fixing roller 51 due to the flux (see the arrows shown in the figure) generated in the electromagnetic coil 82, thereby heating the entire part to be heated 511.

However, when printing processing is repeatedly conducted using a paper sheet having the width smaller than the longitudinal width of the fixing roller 51, so called the maximum paper-passing size, the temperature of non-paper-passing areas R in the vicinity of both the edges of the fixing roller 51 rises higher than that of the vicinity of the center of the fixing roller 51.

In the copier X, since the drive of the heater 52 is controlled so that the temperature of the vicinity of the center of the fixing roller 51 that has been detected by the center area temperature sensor 53 settles to a predetermined fixing temperature (for example, around 200 centigrade), only the temperature of the non-paper-passing areas R in the vicinity of the edge of the fixing roller 51 continuously increases.

After that, with the rise of the temperature of the non-paper-passing area R in the vicinity of the edge of the fixing roller 51, when the temperature of the part to be heated 511 in the non-paper-passing area R reaches the Curie point (for example, around 220 centigrade), the magnetic quality of the part to be heated 511 in the non-paper-passing area R rapidly decreases.

And then, as illustrated in FIG. 6(*b*), the flux (see the arrows shown in the figure) from the electromagnetic coil 82 leaks to the outside. Consequently, the rapid decrease of eddy current, which is generated by electromagnetic induction, in the part to be heated 511 in the non-paper-passing area R prevents further temperature rise of the non-paper-passing area R. As described, the use of magnetic shunt alloy, as a magnetic material that has Curie point, for the part to be heated 511 prevents excessive heating of the part to be heated 511 above the Curie point in the fixing device 5.

On the other hand, as illustrated in FIG. 6(*b*), the flux, which is leaked from the electromagnetic coil 82 of the heater 52 through the part to be heated 511 in the non-paper-passing areas R in the vicinity of both the edges of the fixing roller 51, acts on the electromagnetic coils 71 and 72.

This generates induced electromotive force (induced current) in the electromagnetic coils 71 and 72 due to the flux leaked from the part to be heated 511. The induced electromotive force generated in the electromagnetic coils 71 and 72 then flows into the resistance heating element 173.

The resistance heating element 173 therefore produces heat with induced electromotive force generated in the electromagnetic coils 71 and 72, thereby heating the part to be heated 511 in the vicinity of the center of the fixing roller 51.

As described above, in the fixing device 5, the energy of the flux, which is leaked from the vicinities of the edges of the fixing roller 51 and has been uselessly consumed in conventional arts, is utilized for such as the resistance heating element 173 that auxiliary-heats the vicinity of the center of the fixing roller 51, so that the energy, which is necessary for controlling the temperature of the vicinity of the center of the fixing roller 51 to be settled to a predetermined fixing temperature, is reduced. In particular, the operating load of the heater 52 can be reduced.

In the present embodiment, the electromagnetic coil 82 is coiled in the direction same as the circumferential direction of the fixing roller 51 as an example, however, the embodiment can also be applicable to the configuration in which the electromagnetic coil 82 is coiled in the longitudinal direction of the fixing roller 51.

Next, an embodiment of the third aspect of this invention in which the energy of the leaked flux is utilized to heat the vicinity of the center of the fixing roller is described. The copier X in accordance with the present aspect of this invention is the same as the one in FIG. 1 described above, and the explanation thereof is omitted. The copier X according to one embodiment of the present aspect has a particular feature in its structure of the fixing device 5, and the following describes this feature in details.

Figure 7:
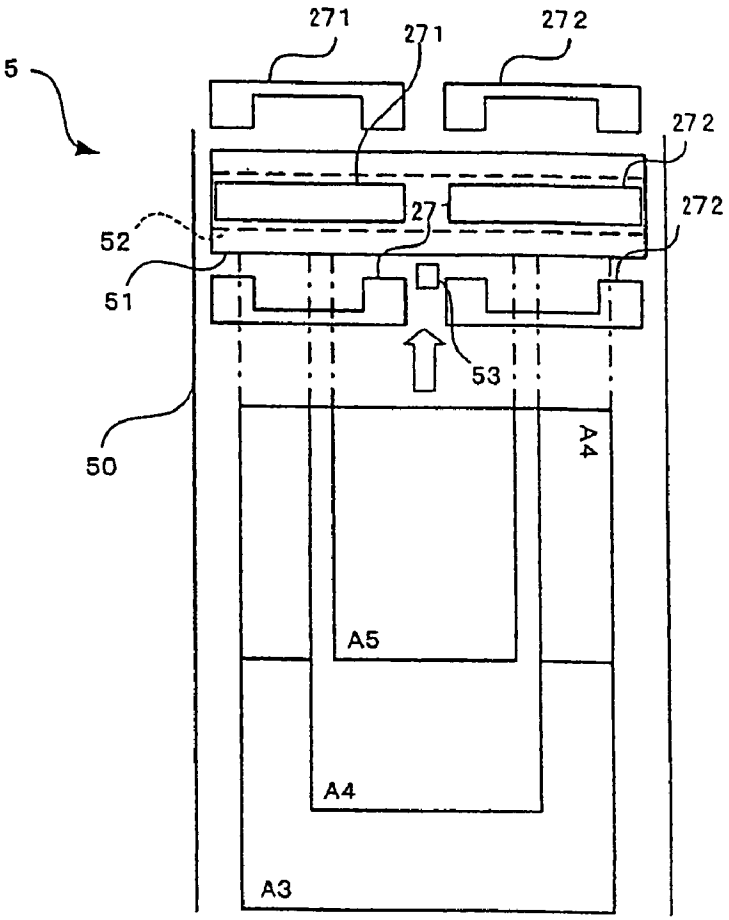
FIG. 7 shows a pattern diagram schematically illustrating a fixing device according to an embodiment of the third aspect of this invention of when the energy of the leaked flux is utilized to heat the vicinity of the center of the fixing roller.
Figure 7:
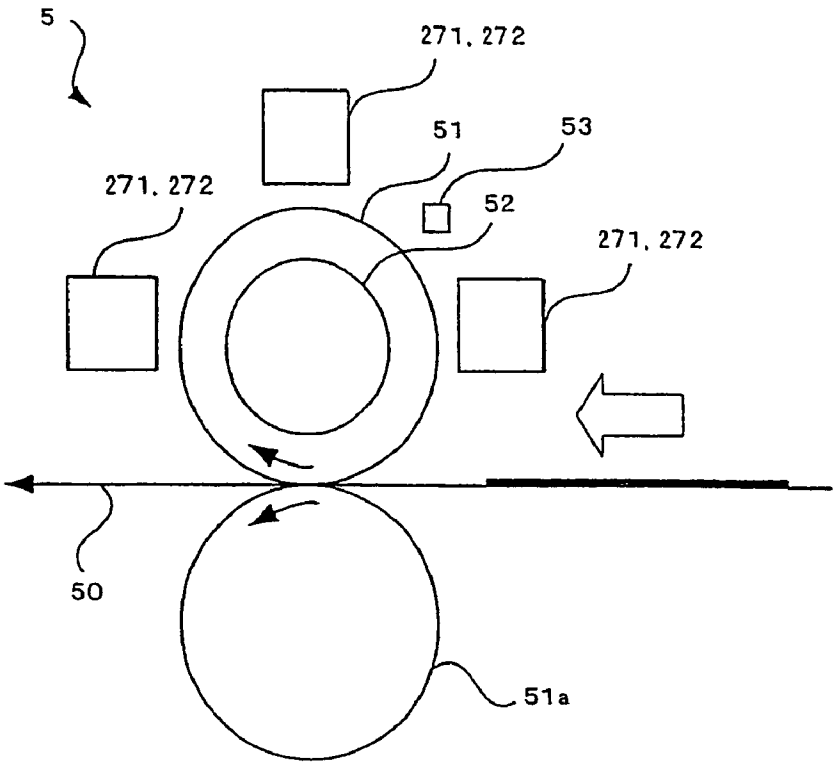

Firstly, as referring to the pattern diagram in FIG. 7, the general structure of the fixing device 5 is described. Here, FIG. 7(*a*) shows a side view and FIG. 7(*b*) shows an overhead view both of the fixing device 5.

As shown in FIG. 7, the fixing device 5 comprises; a fixing roller 51 for melt-fixing a toner image on various sized paper sheets such as A3 to A5 on which the toner image has already attached by the image forming unit 4, a pressing roller 51*a* which revolves as pressure welding the paper sheet along with the fixing roller 51, a heater 52 of electromagnetic induction heat system provided inside of the fixing roller 52 for heating thereof (one example of a heating means of electromagnetic induction), a center area temperature sensor 53 such as thermistor placed in the vicinity of the center of the fixing roller 51, and later-described magnetic bodies 271 and 272 (one example of a flux guiding means).

This point is the same as the first and second aspects of this invention.

The center area temperature sensor 53 detects the temperature in the vicinity of the center of the fixing roller 51, and inputs the detection result into the controller 6. The controller 6 conducts the drive control of the heater 52 according to the detected temperature input from the center area temperature sensor 53, so that the temperature of the fixing roller 51 settles to a predetermined fixing temperature (for example, around 200 centigrade). Regarding the temperature control of the fixing roller 51, there is no difference from conventional devices, and the detailed explanation thereof is eliminated.

Figure 8:
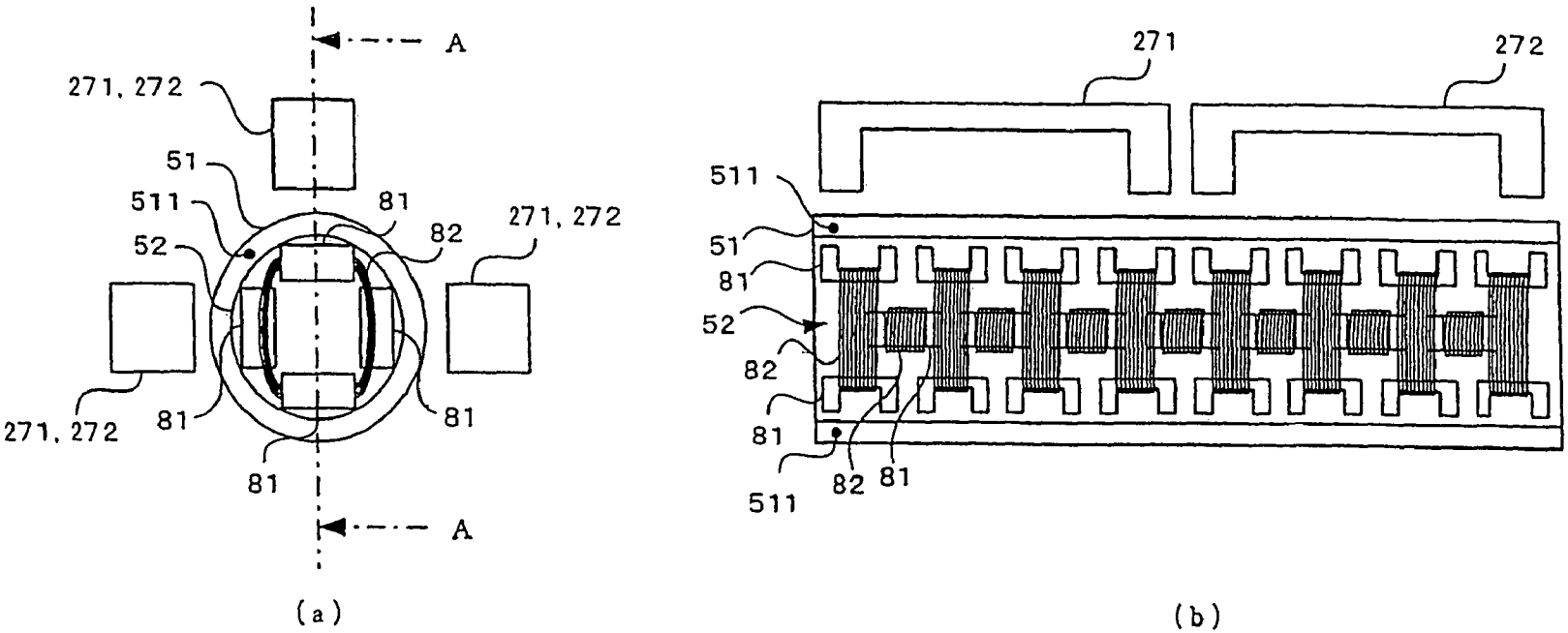
FIG. 8 shows a pattern diagram illustrating the inner structure of a fixing device according to an embodiment of the third aspect of this invention of when the energy of the leaked flux is utilized to heat the vicinity of the center of the fixing roller.

Next, as referring now to FIG. 8, the fixing device 5 is described in details. Here, FIG. 8(*a*) shows a longitudinal cross-sectional view of the heater 52, and FIG. 8(*b*) shows a cross-sectional view which is viewed along the arrow "A" and taken along the line A-A in FIG. 8(*a*).

As shown in FIG. 8, the fixing roller 51 is formed in a hollow cylinder shape, and has a part to be heated 511 formed with magnetic shunt alloy (one example of magnetic material), that has the Curie point (for example, around 220 centigrade). The magnetic shunt alloy may be, for example, alloy such as iron, nickel, and chrome. As described above, the magnetic shunt alloy has a property for rapidly decreasing its magnetic quality when its temperature reaches the Curie point. In addition, any magnetic material that has Curie point, other than magnetic shunt alloy, may be used.

In the fixing device 5, when printing output is conducted by using a paper sheet having the width smaller than the maximum paper-passing width of the fixing roller 51, and moreover, when the temperature of the non-paper-passing areas in the vicinity of the edges of the fixing roller 51 rises and exceeds the Curie point, the magnetic quality of the non-paper-passing area rapidly decreases, thereby rapidly reducing the eddy current generated by electromagnetic induction. This allows to secure the safety by preventing excessive heating of the vicinities of the edges of the fixing roller 51 without using a temperature sensor that detects the temperature of the vicinities of the edges.

This point is also the same as the first and second aspects of this invention.

On the other hand, the heater 52 comprises electromagnetic coils 82 coiled sequentially to a plurality of iron cores 81 and a driving circuit 83 (see FIG. 9) for applying alternating current to the electromagnetic coil 82.

The heater 52 generates flux (magnetic field) at the electromagnetic coil 82 by applying alternating current thereto from the driving circuit 83 (see FIG. 9), so that eddy current (induced current) is occurred in the part to be heated 511 in the fixing roller 51 by electromagnetic induction, thereby heating the part to be heated 511. In addition, the fixing roller 51 is revolved by a driving means not shown, so as to be heated uniformly in its whole circumference by the heater 52.

As illustrated in FIG. 8, provided in the circumference of the fixing roller 51 in the fixing device 5 are magnetic bodies 271 and 272 (one example of a flux guiding means), which have a nearly-U shape and extend across from the vicinity of the edge of the fixing roller 51 to the vicinity of the center of the fixing roller 51. The magnetic bodies 271 and 272 may be placed in a chassis either of the fixing device 5 or of the present copier X. The magnetic bodies 271 and 272 are made of alloy such as ferrite or vanadium of high-permeability, and provide a channel for the flux.

The magnetic bodies 271 and 272 are positioned corresponding to the position of iron cores 81 inside of the heater 52. Additionally, one example of the structure in which three pairs of the magnetic bodies 271 and 272 are provided is illustrated in FIG. 8, however, there may be at least one pair of the magnetic bodies 271 and 272. Moreover, in an image forming apparatus in which the paper sheet passing on the fixing roller 51 passes along any one of the edges of the fixing roller 51, the magnetic body that extends across from the vicinities of the edges of the fixing roller 51 to the vicinity of the center thereof may be provided.

In the thus constituted fixing device 5, when the flux is leaked from the vicinities of the edges of the fixing roller 51, the flux is guided by the magnetic bodies 271 and 272 to the vicinity of the center of the fixing roller 51.

Figure 9B:
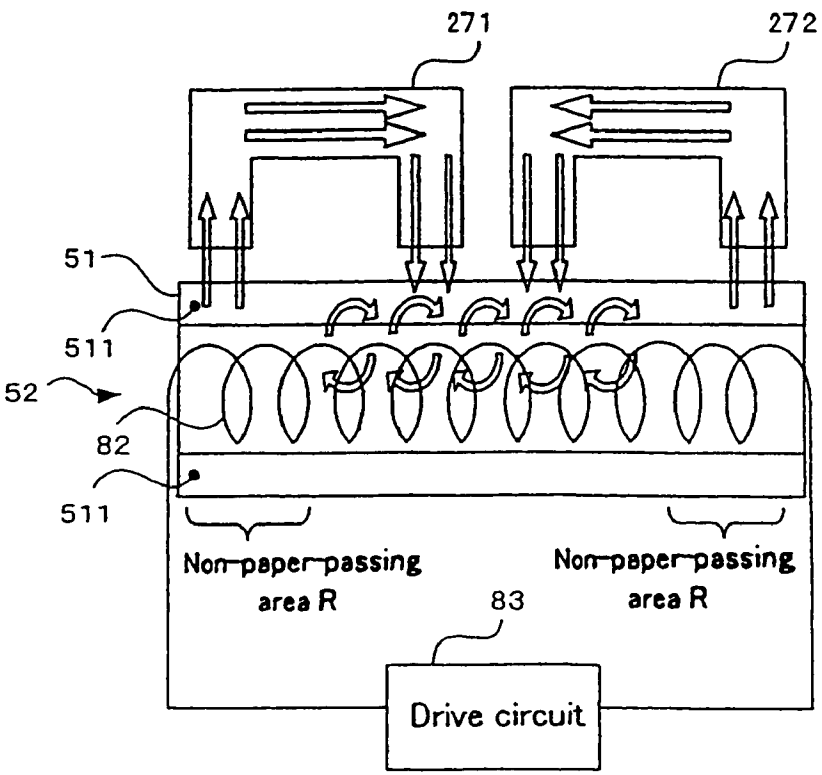
FIG. 9 shows a pattern diagram of the general concept for explaining a state of the flux in a fixing device according to an embodiment of the third aspect of this invention of when the energy of the leaked flux is utilized to heat the vicinity of the center of the fixing roller.
Figure 9A:
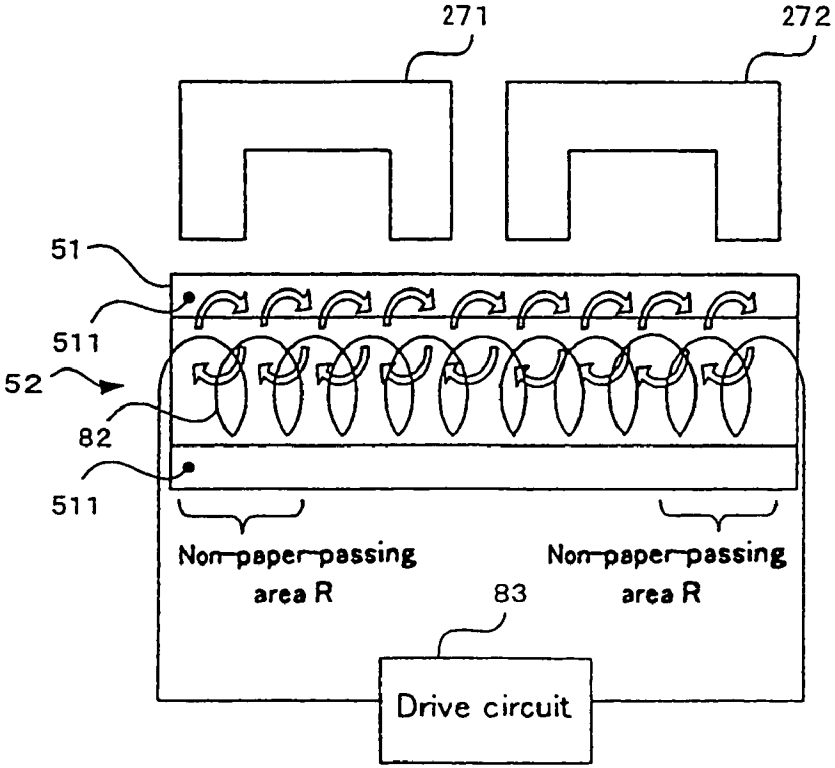

In what follows, as referring now to FIG. 9, a state of the flux in the fixing device 5 is described. Here, FIG. 9(*a*) shows a pattern diagram of the general concept of a state of the flux of when the temperature of the vicinities of the edges of the fixing roller 51 is lower than the Curie point, and FIG. 9(*b*) also shows a pattern diagram of the general concept of a state of the flux of when the temperature of the vicinities of the edges of the fixing roller 51 reaches the Curie point.

As shown in FIG. 9(*a*), in the condition when the temperature in the vicinity of the edge of the fixing roller 51 is lower than the Curie point, eddy current (induced current) by electromagnetic induction occurs in the entire part to be heated 511 of the fixing roller 51 due to the flux (see the arrows shown in the figure) generated in the electromagnetic coil 82, thereby heating the entire part to be heated 511.

However, when printing processing is repeatedly conducted using a paper sheet having the width smaller than the longitudinal width of the fixing roller 51, so called the maximum paper-passing size, the temperature of non-paper-passing areas R in the vicinity of both the edges of the fixing roller 51 rises higher than that of the vicinity of the center of the fixing roller 51.

In the copier X, since the drive of the heater 52 is controlled so that the temperature of the vicinity of the center of the fixing roller 51 that has been detected by the center area temperature sensor 53 settles to a predetermined fixing temperature (for example, around 200 centigrade), only the temperature of the non-paper-passing area R in the vicinity of the edge of the fixing roller continuously increases.

After that, with the rise of the temperature of the non-paper-passing area R in the vicinity of the edge of the fixing roller 51, when the temperature of the part to be heated 511 in the non-paper-passing area R reaches the Curie point (for example, around 220 centigrade), the magnetic quality of the part to be heated 511 in the non-paper-passing area R rapidly decreases.

And then, as illustrated in FIG. 9(*b*), the flux (see the arrows shown in the figure) from the electromagnetic coil 82 leaks to the outside. Consequently, the rapid decrease of eddy current, which is generated by electromagnetic induction, in the part to be heated 511 in the non-paper-passing area R prevents further temperature rise of the non-paper-passing area R. As described, the use of magnetic shunt alloy as magnetic material that has Curie point for the part to be heated 511 prevents excessive heating of the part to be heated 511 above the Curie point in the fixing device 5.

On the other hand, as illustrated in FIG. 9(*b*), the flux that is leaked from the electromagnetic coil 82 of the heater 52 through the part to be heated 511 in the non-paper-passing areas R in the vicinity of both the edges of the fixing roller 51, is guided to the part to be heated 511 in the vicinity of the center of the fixing roller 51 by the magnetic bodies 271 and 272.

Consequently, this causes the flux in the part to be heated 511 in the vicinity of the center of the fixing roller 51 to increase, thereby increasing the eddy current (induced current) generated in the part to be heated 511 in the vicinity of the center by electromagnetic induction. In short, the energy of the flux leaked from the vicinities of the edges of the fixing roller 51 is utilized for heating the vicinity of the center of the fixing roller 51.

As described above, in the fixing device 5, the energy of the flux, which is leaked from the vicinities of the edges of the fixing roller 51 and has been uselessly consumed in conventional arts, is utilized for heating the vicinity of the center of the fixing roller 51, so that the energy, which is necessary for controlling the temperature of the vicinity of the center of the fixing roller 51 to be settled to a predetermined fixing temperature, is reduced. In particular, the operating load of the heater 52 can be reduced. Consequently, the temperature rise of the vicinity of the center of the fixing roller 51 can be accelerated while that of the vicinities of the edges of the fixing roller 51 being suppressed, thereby shortening the operating time of the heater 52.

In the present embodiment, the electromagnetic coil 82 is coiled in the direction same as the circumferential direction of the fixing roller 51 as an example, however, the embodiment can also be applicable to the configuration in which the electromagnetic coil 82 is coiled in the longitudinal direction of the fixing roller 51.

What is claimed is:

1. A fixing device comprising;

a fixing roller having a part to be heated, which is made of magnetic material that has Curie point, and a heating means of electromagnetic induction for heating said part to be heated by electromagnetic induction, wherein one or a plurality of generating means of induced electromotive force for generating induced electromotive force by means of flux, which has passed from said heating means of electromagnetic induction through said part to be heated in the vicinities of the one or both edges of said fixing roller, and one or a plurality of storing means of induced electromotive force for storing induced electromotive force generated by said generating means of induced electromotive force, are provided.

2. A fixing device according to claim 1, wherein said magnetic material is magnetic shunt alloy.

3. A fixing device according to any one of claims 1 or 2, wherein said generating means of induced electromotive force is an electromagnetic coil.

4. A fixing device according to claims 1, wherein said storing means of induced electromotive force is a secondary battery or a condenser.

5. A fixing device according to claims 1 further comprising an excessive heating detecting means for detecting whether or not excessive heating of the vicinities of the one or both edges of said fixing roller or an area in the vicinity of the center of said fixing roller is occurred, based on electricity or rate of electricity change of induced electromotive force stored in said storing means of induced electromotive force.

6. An image forming apparatus, comprising a fixing device, wherein;

a fixing roller having a part to be heated, which is made of magnetic material that has Curie point, and a heating means of electromagnetic induction for heating said part to be heated by electromagnetic induction are provided, and said image forming apparatus further comprising;

one or a plurality of generating means of induced electromotive force for generating induced electromotive force by means of flux, which has passed from said heating means of electromagnetic induction through said part to be heated in the vicinities of the one or both edges of said fixing roller, and one or a plurality of storing means of induced electromotive force for storing induced electromotive force that is generated by said generating means of induced electromotive force.

7. A fixing device comprising;

a fixing roller having a part to be heated, which is made of magnetic material that has Curie point, and a heating means of electromagnetic induction for heating said part to be heated by electromagnetic induction, wherein one or a plurality of generating means of induced electromotive force for generating induced electromotive force by means of flux, which has passed from said heating means of electromagnetic induction through said part to be heated in the vicinities of the one or both edges of said fixing roller, and one or a plurality of heating means of induced electromotive force for heating an area in the vicinity of the center of said fixing roller with the induced electromotive force that is generated by said generating means of induced electromotive force, are provided.

8. A fixing device according to claim 7, wherein said magnetic material is magnetic shunt alloy.

9. A fixing device according to any one of claims 7 or 8, wherein said generating means of induced electromotive force is an electromagnetic coil.

10. A fixing device according to claims 7, wherein said heating means of induced electromotive force is a resistance heating element or a halogen heater.

11. An image forming apparatus, comprising a fixing device, wherein;

a fixing roller having a part to be heated, which is made of magnetic material that has Curie point, and a heating means of electromagnetic induction for heating said part to be heated by electromagnetic induction are provided, and said image forming apparatus further comprising;

one or a plurality of generating means of induced electromotive force for generating induced electromotive force by means of flux, which has passed from said heating means of electromagnetic induction through said part to be heated in the vicinities of the one or both edges of said fixing roller, and one or a plurality of heating means of induced electromotive force for heating an area in the vicinity of the center of said fixing roller with the induced electromotive force that is generated by said generating means of induced electromotive force.

12. A fixing device comprising;

a fixing roller having a part to be heated, which is made of magnetic material that has Curie point, and a heating means of electromagnetic induction for heating said part to be heated by electromagnetic induction, wherein one or a plurality of flux guiding means for guiding flux, which has passed from said heating means of electromagnetic induction through said part to be heated in the vicinities of the one or both edges of said fixing roller, to said part to be heated in an area in the vicinity of the center of said fixing roller are provided.

13. A fixing device according to claim 12, wherein said magnetic material is magnetic shunt alloy.

14. A fixing device according to any one of claims 12 or 13, wherein said flux guiding means is a magnetic body having a nearly-U shape and disposed as extending across from an area in the vicinity of the edge of said fixing roller to an area in the vicinity of the center of said fixing roller.

15. An image forming apparatus, comprising a fixing device, wherein;

a fixing roller having a part to be heated, which is made of magnetic material that has Curie point, and a heating means of electromagnetic induction for heating said part to be heated by electromagnetic induction are provided, and said image forming apparatus further comprising, a flux guiding means for guiding flux, which has passed from said heating means of electromagnetic induction through said part to be heated in the vicinities of the one or both edges of said fixing roller, to said part to be heated in an area in the vicinity of the center of said fixing roller.

* * * * *